US010733824B2

(12) United States Patent
Dai

(10) Patent No.: US 10,733,824 B2
(45) Date of Patent: Aug. 4, 2020

(54) UNLOCKING METHOD USING SOUND PASSWORD AND A SMART LOCK

(71) Applicant: QINGDAO GOERTEK TECHNOLOGY CO., LTD., Qingdao, Shandong Province (CN)

(72) Inventor: Zhimei Dai, Qingdao (CN)

(73) Assignee: QINGDAO GOERTEK TECHNOLOGY CO., LTD., Qingdao (CN)

( * ) Notice: Subject to any disclaimer, the term of this patent is extended or adjusted under 35 U.S.C. 154(b) by 0 days.

(21) Appl. No.: 16/090,096

(22) PCT Filed: Nov. 22, 2016

(86) PCT No.: PCT/CN2016/106700
§ 371 (c)(1),
(2) Date: Sep. 28, 2018

(87) PCT Pub. No.: WO2017/166832
PCT Pub. Date: Oct. 5, 2017

(65) Prior Publication Data

US 2019/0114854 A1 Apr. 18, 2019

(30) Foreign Application Priority Data

Mar. 31, 2016 (CN) ..... 2016 1 0196764

(51) Int. Cl.
*G07C 9/32* (2020.01)
*G07C 9/00* (2020.01)
*G10K 11/178* (2006.01)

(52) U.S. Cl.
CPC ..... *G07C 9/32* (2020.01); *G07C 9/00174* (2013.01); *G07C 9/00309* (2013.01); *G10K 11/178* (2013.01); *G10K 11/17854* (2018.01); *G07C 2009/00801* (2013.01); *G10K 2210/10* (2013.01)

(58) Field of Classification Search
None
See application file for complete search history.

(56) References Cited

U.S. PATENT DOCUMENTS

2009/0150150 A1* 6/2009 Yang ..... G06F 21/32 704/246

* cited by examiner

*Primary Examiner* — Daniell L Negron
(74) *Attorney, Agent, or Firm* — Jiwen Chen

(57) ABSTRACT

A sound password unlocking method, comprises unlocking procedures: collecting a sound password signal that the user plays and performing the analog to digital conversion (11); Inputting the converted sound password signal to a reference signal input end of an adaptive noise cancellation module; inputting an original signal to an original signal input end of the adaptive noise cancellation module; producing a first output signal in adaptive noise cancellation (12); Calculating the difference between the first output signal and the original signal (13); Comparing the difference between the first output signal and the original signal with a standard difference; determining the sound password is correct if the two difference values are identical and enabling the motor to drive a lock cylinder to open otherwise no unlock operation executed (14). The sound password unlocking method provided by the present invention, based on adaptive noise cancellation is hard to be cracked, which is reliable and safe. The lock could be locked by sound password recognition.

1 Claim, 2 Drawing Sheets

UNLOCKING METHOD USING SOUND PASSWORD AND A SMART LOCK

This is a U.S. national stage application of PCT Application No. PCT/CN2016/106700 under 35 U.S.C. 371, filed Nov. 22, 2016 in Chinese, claiming priority of Chinese Application No. 201610196764.1, filed Mar. 31, 2016, all of which are hereby incorporated by reference.

CROSS REFERENCE

The present application is based on and claims priority to Chinese patent application No. 201610196764.1 filed on Mar. 31, 2016, the content of which are also hereby incorporated by reference in its entirety.

TECHNICAL FIELD

The present invention relates to a sound password unlocking method and a sound password smart lock.

BACKGROUND OF THE INVENTION

Typical smart locks sold in the market are NFC lock, fingerprint lock and keypad lock. The problem with NFC lock is that the card going with is easy to be damaged, and the trouble that both of the fingerprint lock and keypad lock have is that the password is easy to be cracked with silver powder.

An alternative of the prior art is to switch to sound recognition, in which password is replaced with a unique audio file, such as playing a melody as a sound password to perform the unlock operation. However, the sound password entry is not safe because the data that describes a sound is vulnerable to being pilfered. If the unlock algorithm is comparatively simple, the sound data associated with a lock might be copied through eavesdrop and recording, even copied through surveillance tapes.

In order to solve the problems of the prior art, such that the password lock is easy to be cracked and low in safety, the present invention provides a sound password unlocking method and a sound password smart lock based on adaptive noise cancellation for improving the safety.

BRIEF SUMMARY OF THE INVENTION

A sound password unlocking method comprises unlocking procedures:

(11) Collecting a sound password signal that the user plays and performing the analog to digital conversion;

(12) Inputting the converted sound password signal to a reference signal input end of an adaptive noise cancellation module; inputting an original signal to an original signal input end of the adaptive noise cancellation module; producing a first output signal in adaptive noise cancellation;

(13) Calculating the difference between the first output signal and the original signal;

(14) Comparing the difference between the first output signal and the original signal with a standard difference; determining the sound password is correct if the two difference values are identical and enabling the motor to drive a lock cylinder to open otherwise no unlock operation executed.

Further, calculating the signal-to-noise ratio gain between the first output signal and the original signal calculated in step (13);

Comparing the signal-to-noise ratio gain with a standard signal-to-noise ratio gain in step (14); if the two are identical, enabling the motor to drive the lock cylinder to open otherwise no unlock operation executed.

Further, preceding the unlocking procedures further comprises steps to calculate the standard signal-to-noise ratio gain, which comprises:

(01) Obtaining the original signal and a standard reference signal, wherein the original signal and the standard reference signal are in digital form;

(02) Transmitting the original signal into the original signal input end of the adaptive noise cancellation module and transmitting the standard reference signal into the reference signal input end; producing a second output signal in adaptive noise cancellation;

(03) Calculating the signal-to-noise ratio gain between the second output signal and the original signal to obtain the standard signal-to-noise ratio gain.

Further, in Step (13), the method for calculating the signal-to-noise ratio gain of the original signal before and after adaptive noise cancellation comprises the following steps:

(131) Calculating the signal-to-noise ratio of the first output signal;

(132) Calculating the signal-to-noise ratio of the original signal;

(133) Calculating the difference value between the signal-to-noise ratio of the first output signal and the signal-to-noise ratio of the original signal; obtaining the signal-to-noise ratio gain between the first output signal and the original signal.

Further, the original signal is obtained through analog to digital conversion of a primal analogical signal.

Further, the sampling frequency set for the analog to digital conversion of the sound password signal in Step (11) is same as the sampling frequency set for the analog to digital conversion of the primal analogical signal.

Further, the standard reference signal is a single-frequency noise signal.

Based on the above illustrated password unlocking method, the present invention further provides a sound password lock, comprises:

A sound collection module configured to collect a sound password signal that the user plays;

An analog-digital conversion module configured to perform analog to digital conversion of the collected sound password;

An adaptive noise cancellation module configured to process the converted sound password signal and an original signal in adaptive noise cancellation, and obtain a first output signal;

A control module configured to calculate the signal-to-noise ratio gain between the first output signal and the original signal, and to compare the signal-to-noise ratio gain with the standard signal-to-noise ratio gain; and to enable the motor to drive lock cylinder to open if the two signal-to-noise ratio gain are identical proving the sound password signal is correct for entry; otherwise no unlock operation executed.

Further, the adaptive noise cancellation module is an adaptive noise cancellation filter.

Further, the sound password lock comprises a storage module configured to store the standard signal-to-noise ratio gain and the original signal.

The sound password unlocking method provided by the present invention, based on adaptive noise cancellation is hard to be cracked, which is reliable and safe. The lock could be opened by sound password recognition.

DETAILED DESCRIPTION OF THE INVENTION

Figure 1:
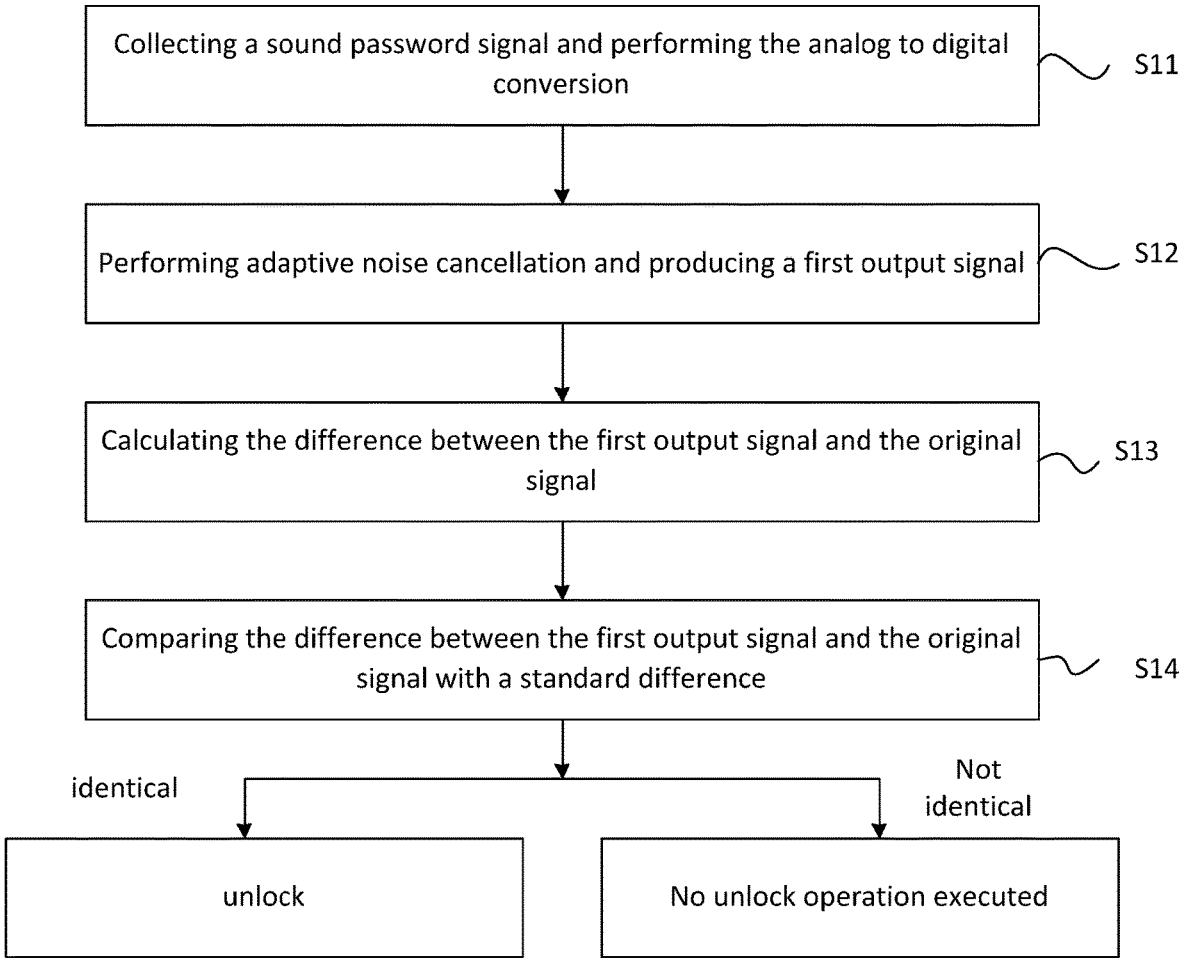
FIG. 1 is a flow chart showing an embodiment of the sound password unlocking method provided by the present invention.

Typical smart locks sold in the market, as NFC lock, fingerprint lock and keypad lock, contain various problems, such that the card matched with NFC lock is easy to be damaged and passwords of the fingerprints lock and keypad lock are easy to be cracked using silver powder. Hence, smart lock with sound recognition becomes more and more popular because it requires no extra kit beyond mics built into smart phones or other mobile terminals as such. The unlock process is also simplified as a sound password is played on a smart phone or a terminal, and then the sound data would be analyzed and matched against a record sample logged in. If the sound playing is matched with the sample, the lock would be opened automatically. Technically, in the prior art the typical sound identification method adopted by the sound-key smart lock comprises the following steps: collecting a sound password, which is transmitted by a mobile terminal, into a control unit; comparing the received sound password with a record password sample; if the sound password is matched with the sample, the mechanical lock cylinder would be automatically unlocked. However the sound identification method is considered vulnerable due to the fact that the correct password may be copied secretly. The present invention is to provide a more reliable sound-key smart lock which is hard to be cracked by employing the adaptive noise cancellation technology, in which the sound password authentication entry is only permitted if features, as signal sampling frequency, signal-to-noise ratio and the like, are matched.

The accompanying drawings are included to provide a further understanding of the invention, and are incorporated in and constitute a part of this specification. The drawings illustrated embodiments of the invention and, together with the description, serve to explain the principles of the invention.

Embodiment 1 the present embodiment presents a sound password unlocking method, which comprises the following steps:

S11. Collecting the sound password signal that the user plays and converting analog signals received to digital signals; as the user playing the sound password via a mobile terminal, the smart lock collects sound signals in the meanwhile. However, the collected signals are in the form of analogue, which could not be recognized, analyzed and processed directly and required to be converted to the digital form.

S12. Inputting the converted sound password signal to a reference signal input end of an adaptive noise cancellation module; inputting an original signal to an original signal input end of the adaptive noise cancellation module; producing a first output signal in adaptive noise cancellation.

S13. Calculating the difference between the first output signal and the original signal; the specific difference could be explicitly presented in any one of such parameters: signal-to-noise ratio of the output signal, signal-to-noise ratio gain between the input signal and output signal and mean square error of output signal and the like.

S14. Comparing the difference between the first output signal and the original signal with a standard difference, if they are matched, it affirms that the sound password is correct and the mechanical lock cylinder is driven by a motor to unlock automatically, otherwise the unlock request is rejected.

In this embodiment, the theory of the adaptive noise cancellation adopted in S12 is illustrated as follows: the adaptive noise cancellation module is configured with two signal input ends and one output end, the two signal input ends respectively serve as the reference signal input end and the original signal input end; the sound password signal collected is transmitted as the reference signal input and the original signal which was previously stored in the smart lock is transmitted over the original signal input end, wherein the original signal is an audio input containing a standard reference signal and other corrupted signals, and the standard reference signal is the standard sound password that the sound password the user playing for entry should be identical with. It should be noted that, in the present invention, the sound password signal that the user plays would not be directly compared with the standard sound password. Based on the adaptive noise cancellation theory, the original signal and the reference signal are respectively input into the adaptive noise cancellation module. Due to the fact that, within the normal unlock process, the sound password the user playing is supposed to be identical with the standard sound password, the output obtained through the adaptive filter of the sound password that the user plays from the original signal should be identical with the output obtained through the adaptive filter of the standard sound password from the original signal. In order to minimize the interference caused by various performances of different mobile terminals, the parameter signal-to-noise ratio gain is employed in the comparison of the present embodiment. That is to say, if the sound password that the user plays is identical with the standard sound password, the signal-to-noise ratio gain of the output signal obtaining from the adaptive noise cancellation of the sound password that the user plays from the original signal should be identical with that of the output signal obtained from the adaptive noise cancellation of the standard sound password from the original signal. In this way, if the sound password that the user plays deviates from the standard sound password, the difference between the output signals obtained from the adaptive noise cancellation could be obvious. If the playing sound password is a pilfered copy, it inevitably contains noise or delay which are almost impossible to be modified. Hence, the safety of unlocking method could be improved.

Specifically, in S13, calculating the signal-to-noise ratio gain between the first output signal and the original signal;

In S14, comparing the signal-to-noise ratio gain worked out in S13 with a standard signal-to-noise ratio gain; if the two are same, controlling the motor to drive the mechanical lock cylinder opening; otherwise none of unlock process being executed.

The standard signal-to-noise ratio gain is the increase between the signal-to-noise ratio of the output signal, which obtained from the adaptive noise cancellation of the standard sound password from the original signal, and the signal-to-noise ratio of the original signal. To reduce the burden of calculation, the standard signal-to-noise ratio is calculated and stored in the smart lock in advance. A process, preceding the unlock procedure, to calculate the standard signal-to-noise ratio gain is included, which comprises the following steps:

S01, obtaining the original signal and the standard reference signal, wherein the original signal and the standard reference signal are in digital form;

S02, transmitting the original signal into the original signal input end of the adaptive noise cancellation module and transmitting the standard reference signal into the reference signal input end; producing a second output signal in adaptive noise cancellation.

S03, calculating the signal-to-noise ratio gain between the second output signal and the original signal, which serves as the standard signal-to-noise ratio gain.

In Step S13, the method for calculating the signal-to-noise ratio gain of the original signal before and after adaptive noise cancellation comprises the following steps:

S131, calculating the signal-to-noise ratio of the first output signal;

S132, calculating the signal-to-noise ratio of the original signal;

S133, calculating the difference between the signal-to-noise ratio of the first output signal and the signal-to-noise ratio of the original signal, the difference value is the signal-to-noise ratio gain between the first output signal and the original signal.

The original signal being transmitted to the adaptive noise cancellation module is obtained through AD conversion of primal analogical signals. It is only required to collect and convert in the first time and then stored in advance, for each of the unlocking process, digital original signal could be used directly.

While the reference signal input end receiving signal, an analog-digital conversion module starts to work. The synchronization of the original signal and reference signal has to be ensured because if the sampling frequency is different, the length of signal received in the same period would be different causing the failure of the adaptive noise cancellation. Therefore, the sampling frequency set for the AD conversion of the sound password signal in S11 is same as that set for the AD conversion of the primal analogical signal. In the present, the sampling frequency is preferably 48 kHz.

In order to perform better, the standard reference signal is a single-frequency noise signal, which is also used as the sound key. The standard reference signal is stationary with fixed length, amplitude, and frequency.

Figure 2:
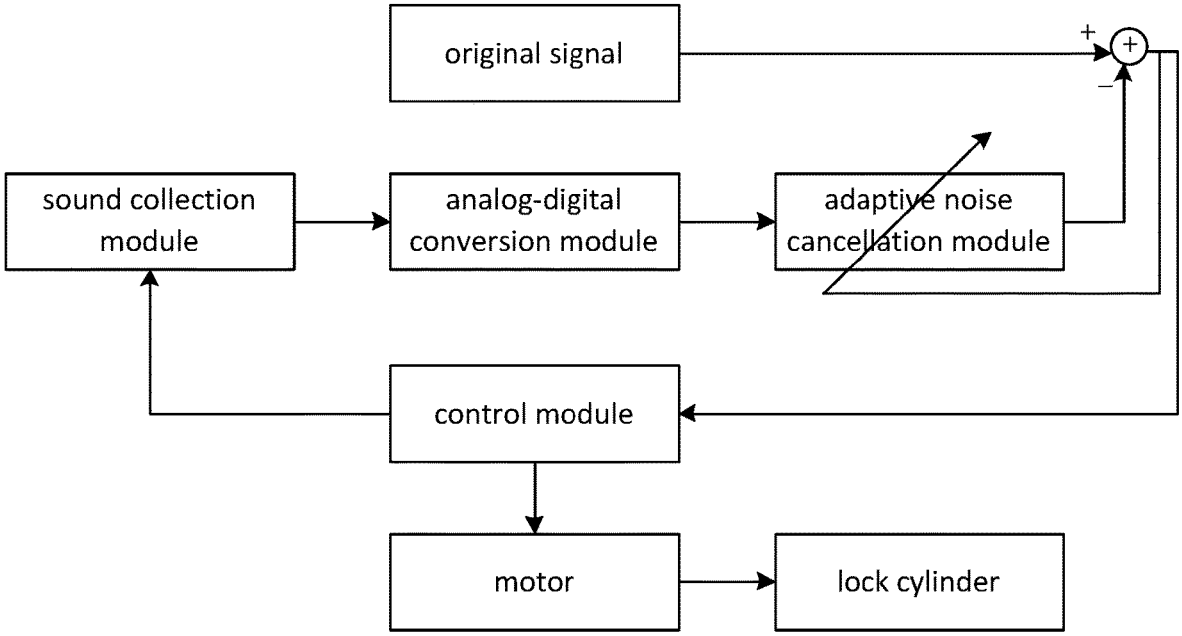
FIG. 2 is a block chart showing an embodiment of the sound password lock provided by the present invention.

Based on the unlocking method using sound password illustrated in Embodiment 1, the present embodiment discloses a sound password lock. As shown in FIG. 2, the sound password lock comprises:

A sound collection module, which is configured to collect a sound password signal that the user plays;

An analog-digital conversion module, which is configured to convert the collected sound password signal into a digital form;

An adaptive noise cancellation module, which is configured to process the converted sound password signal and the original signal based on the adaptive noise cancellation algorithm, and obtain the first output signal;

A control module, which is configured to calculate the signal-to-noise ratio gain between the first output signal and the original signal, and to compare the signal-to-noise ratio gain with the standard signal-to-noise ratio gain; and to enable the motor to drive lock cylinder to open if the two signal-to-noise ratio gain are identical, which means the sound password signal is correct. Otherwise none of unlocking process is executed.

In this embodiment, based on the adaptive noise cancellation theory, the original signal and the reference signal are respectively transmitted into the adaptive noise cancellation module; if the sound password signal that the user plays are identical with standard sound password, the filtered output of the sound password signal from the original signal should be same as the filtered output of the standard sound password from the original signal. In this way, the sound password is hard to be cracked and the safety of smart lock could be improved.

The adaptive noise cancellation module is an adaptive noise cancellation filter, the adaptive noise cancellation could be realized with in a DSP (Digital Signal Processor).

The control module comprises a main control unit and a motor driving module, wherein the main control unit could be realized by a Single Chip Microcomputer. The execution of unlocking is determined according to the output of the DSP.

The standard signal-to-noise ratio gain is the increase between the signal-to-noise ratio of the output signal obtained from the adaptive noise cancellation of the standard sound password from the original signal and the signal-to-noise ratio of the original signal. To reduce the burden of calculation, the standard signal-to-noise ratio is calculated and stored in the smart lock in advance. Hence, a storage module is provided to at least store the standard signal-to-noise ratio gain, the original signal and the like.

It should also be understood that, although described with respect to preferred embodiments of the invention, various changes and/or modifications can be made to the invention without departing from the spirit thereof. In any event, the invention is only intended to be limited by the scope of the following claims.

I claim:

1. A sound password smart lock comprises:

a motor;

a lock cylinder;

a sound collection module configured to collect a sound password signal that a user plays;

an analog-digital conversion module configured to perform analog to digital conversion of a collected sound password;

an adaptive noise cancellation module configured to process the converted sound password signal and an original signal in adaptive noise cancellation, and obtain a first output signal;

a control module configured to calculate the signal-to-noise ratio gain between the first output signal and the original signal, and to compare signal-to-noise ratio gain with the standard signal-to-noise ratio gain; and to enable the motor to drive the lock cylinder to open if the two signal-to-noise ratio gain are identical proving the sound password signal is correct; otherwise no unlock operation executed; and a storage module configured to store the standard signal-to-noise ratio gain and the original signal;

wherein the adaptive noise cancellation module is an adaptive noise cancellation filter.

* * * * *